US006329742B1

(12) United States Patent
Nelson et al.

(10) Patent No.: US 6,329,742 B1
(45) Date of Patent: Dec. 11, 2001

(54) METAL HALIDE LAMP WITH METAL FRAME SUPPORTING A PROTECTIVE SLEEVE

(75) Inventors: Gregory J. Nelson, Eindhoven (NL); Franciscus H. van Lierop, Bath; John S. Bailey, Bradford, both of NY (US)

(73) Assignee: Philips Electronics North America Corp., New York, NY (US)

( * ) Notice: Subject to any disclaimer, the term of this patent is extended or adjusted under 35 U.S.C. 154(b) by 0 days.

(21) Appl. No.: 09/323,806

(22) Filed: Jun. 2, 1999

(51) Int. Cl.[7] ..... H01J 1/02; H01J 61/52; H01J 7/24

(52) U.S. Cl. ..... 313/25; 313/26; 313/36; 313/634

(58) Field of Search ..... 313/25, 634, 26, 313/27, 36, 42, 110, 112

(56) References Cited

U.S. PATENT DOCUMENTS 4,866,342 * 9/1989 Ramaiah et al. ..... 313/639
5,128,106 * 7/1992 Buschmann et al. ..... 422/119
5,327,042 * 7/1994 Bazin et al. ..... 313/25
5,576,592 * 11/1996 Koenigsberg et al. ..... 313/25
5,719,463 * 2/1998 Hassink et al. ..... 313/25

FOREIGN PATENT DOCUMENTS 784334 7/1997 (EP) .
737913 10/1955 (GB) ..... 39/1
WO0011704 3/2000 (WO) ..... H01J/61/34

* cited by examiner

*Primary Examiner*—Michael H. Day
*Assistant Examiner*—Kevin Quarterman
(74) *Attorney, Agent, or Firm*—Dicran Halajian

(57) ABSTRACT

A ceramic metal halide arc tube is surrounded by a protective sleeve supported by a metal frame having current carrying wire frame members brazed into the metal ferrules of a PAR-lamp. Each frame member has an S-shaped bend which engages the lower end of the sleeve, and a spacer separates the upper ends of the frame to create a rigid self-supporting structure.

21 Claims, 1 Drawing Sheet

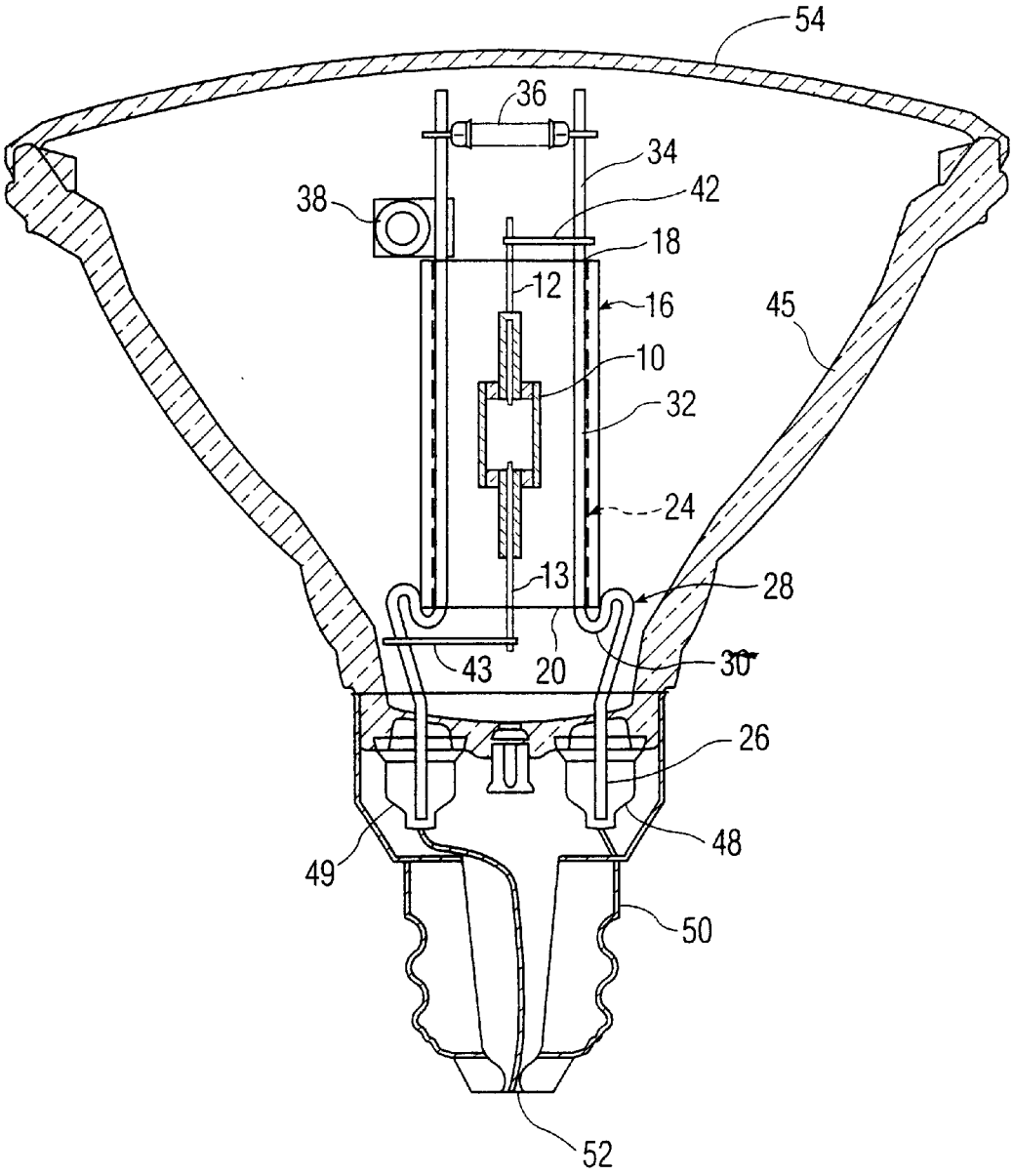
54
36
34
42
38
18
12
16
45
10
32
24
13
28
43
20
30
26
48
49
50
52

METAL HALIDE LAMP WITH METAL FRAME SUPPORTING A PROTECTIVE SLEEVE

BACKGROUND OF THE INVENTION

The invention relates to a lamp of the type having a protective sleeve of quartz surrounding a light source, in particular a metal halide arc tube having a pair of opposed leads. The sleeve is supported by a metal frame comprising a pair of metal frame members which also supply current to the leads.

Protective sleeves of quartz or other transparent material able to withstand operating temperatures are commonly utilized around metal halide arc tubes, also known as high intensity discharge or HID arc tubes, in order to provide protection against non-passive failure during lamp operation. These sleeves act to slow or stop fast moving arc tube fragments and prevent the rupture of the outer lamp envelope. These sleeves may also provide other functions including, but not limited to, reduction of the UV output of the lamp.

Protective sleeves are typically mounted around the arc tube using additional straps or clips around the outside or in the ends of the sleeve. In the case of quartz metal halide arc tube, any metal supports used in the mounting must be kept away from the arc tube or be electrically floating to reduce the rate of sodium loss. An arrangement of this type, having a metal frame member outside of the sleeve, is disclosed in EP 0 784 334.

A known floodlamp having a parabolic aluminized reflector (PAR) utilizes a metal halide arc tube and a protective sleeve supported by straps attached to current carrying wire frame members outside the sleeve. The frame members are brazed into metal ferrules at the base of the reflector, and therefore must have good alignment.

U.S. Pat. No. 5,719,463 discloses a metal halide discharge lamp having a quartz metal halide arc tube with a quartz protective sleeve. A first lead wire for the arc tube passes through the inside of the sleeve and is provided with insulation to prevent sodium loss from the arc tube. This lead wire engages a dimple in the top of the ellipsoidal outer envelope to provide stability. The protective sleeve is supported by insulated stop members fitted in opposed ends of the sleeve and around the first lead wire. One of the stop members is held in place by a bend in the first lead wire, while the other is held in place by a bend in the second lead wire.

U.S. application Ser. No. 09/135,863 discloses a metal halide discharge lamp having a ceramic metal halide arc tube with a quartz protective sleeve. A first lead wire passes through the sleeve and engages a dimple in the outer envelope, but no insulation is necessary because there is no problem of sodium loss with a ceramic arc tube (such as alumina). The sleeve is held in place between a tab on the first lead wire and a terminal on the second lead wire; both lead wires are embedded in the glass stem. According to another embodiment, the sleeve is held in place by bends in the lead wires, which are welded to leads embedded in the stem.

Protected mount designs are typically quite expensive and difficult to mechanize. In addition, most mounts are insufficiently rigid and may come apart with rough lamp handling (as during transportation).

SUMMARY OF THE INVENTION

It is an object of the invention to provide a support frame for a protective sleeve around a light source, in particular a ceramic metal halide arc tube, in a lamp having an outer envelope which does not offer any means of support such as a dimple.

It is a further object, to provide a support frame which can be pre-assembled to the light source and the sleeve, so that the assembly can be fixed in the lamp as a unit.

According to the invention, a pair of frame members extend through the sleeve, and each frame member is a wire which is formed to engage the lower end of the sleeve, preferably by means of an S-shaped bend.

According to a preferred embodiment, the sleeve is held in place axially by a tab such as a getter adjacent to the upper end of the sleeve, and the upper ends of the frame members are held apart by an insulating spacer.

Each frame member is provided with a terminal to which the opposed leads of the arc tube are brazed prior to fitting the sleeve. The tab and spacer are then fixed to form a rigid self-supporting assembly wherein the lower ends of the frame members have a predetermined spacing. This permits insertion into the ferrules of a PAR-type lamp, where they are brazed in place. The lens is then fitted to the reflector without any further assembly steps being necessary.

The lamp according to the invention is therefore especially suited to applications where a pre-assembled light source and sleeve is desirable from a manufacturing standpoint, and good stability is necessary without any support by the outer envelope.

While the invention is particularly suited to lamps having ceramic metal halide arc tubes, it may also find applicability with incandescent light sources such as the IR coated tungsten-halogen lamp disclosed in U.S. Pat. No. 5,670,840.

BRIEF DESCRIPTION OF THE DRAWING

The sole FIGURE is an elevation view of a PAR lamp according to the invention.

DETAILED DESCRIPTION OF THE PREFERRED EMBODIMENT

The arc tube 10 has a cylindrical aluminum oxide envelope having a pair of opposed axial leads 12, 13 extending therefrom and electrodes for maintaining a discharge in the metal halide filling. The arc tube 10 is surrounded by a quartz sleeve 16 having an upper end 18 and a lower end 20. The sleeve 16 is supported by a pair of wire frame members 24 which are substantially identical but for welded-on fittings including terminals 42, 43 and getter 38. The frame members are preferably formed with stainless steel wire, but Mo, Nb, or Ni wire may also be used.

Each frame member 24 has a lower end 26, and S-shaped bend 28, a straight section 32, and an upper end 34. Each S-shaped bend incorporates an upright U-shaped bend 30 which engages the lower end 20 of the sleeve 16. A getter tab 38 positions the sleeve 16 on one of the frame members, and an insulating spacer 36 holds the upper ends 34 apart so that the straight portions 32 bear against the inside surface of sleeve 16. The spacer 36 has opposed metal eyelets which engage the frame wires, and a dielectric rod between the eyelets.

The remainder of the lamp is conventional, and includes a glass envelope 45 with an aluminized inside surface (PAR), a pair of brass ferrules 48 and 49 embedded in the glass, a brass base 50, a center contact 52, and a cover lens 54. The lower ends 26 of frame members 24 are brazed into respective ferrules 48, 49, which in turn are electrically connected to the base 50 and center contact 52.

The lamp is manufactured by holding the frame wires 24 in coplanar relationship in a jig, and welding the arc tube leads 12, 13 to respective terminals 42, 43. The sleeve 16 is then fitted over the wires 24 until the lower end 20 engages the S-shaped bends 28, the tab 38 is welded in place, and the spacer 36 is installed. This produces a rigid self-supporting structure with lower ends 26 having a predetermined spacing for insertion into the ferrules 48, 49 and brazing in place. The cover 54 is then flame sealed or glued in place, and a rugged lamp which withstands jarring is achieved.

The foregoing is exemplary and not intended to limit the scope of the claims which follow.

What is claimed is:

1. A lamp comprising a light source having a pair of opposed leads, a protective sleeve around the light source, said sleeve having an upper end and a lower end, and a metal frame supporting said sleeve, said frame comprising a pair of frame members extending through said sleeve, each said frame member being formed with integral engaging means having a well, said well receiving said lower end of said sleeve, each said frame member being connected to a respective one of said leads.

2. A lamp as in claim 1 further comprising an insulating member fixed between said frame members above said upper end of said sleeve, whereby said light source, said frame members, said sleeve, and said insulating member form a rigid self-supporting structure.

3. A lamp as in claim 1 wherein said frame members are wires.

4. A lamp as in claim 3 wherein said engaging means comprises an S-shaped bend formed in at least one of said wires.

5. A lamp as in claim 1 wherein said lamp further comprises a parabolic aluminized reflector having a pair of contact ferrules in which respective frame members are fixed.

6. A lamp as in claim 1 wherein said light source has a ceramic envelope.

7. A lamp as in claim 1 further comprising a tab fixed to one of said frame members above said upper end of said sleeve, thereby holding said lower end against said support means.

8. A lamp as in claim 1 wherein said frame members are identical.

9. A lamp member as in claim 1 wherein said frame members are electrically connected to respective leads of said light source, and provide current to said light source.

10. A lamp comprising:

a light source having a pair of opposed leads, a sleeve around the light source, said sleeve having an upper end and a lower end, and a frame supporting said sleeve and said light source, said sleeve and said light source being supported solely by said frames said frame comprising a pair of frame members extending through said sleeve, each said frame member being formed with an integral portion having a well, said well receiving said lower end of said sleeve, each said frame member being connected to a respective one of said leads.

11. A lamp as in claim 10, further comprising an insulating member fixed between said frame members above said upper end of said sleeve, whereby said light source, said frame members, said sleeve, and said insulating member form a rigid self-supporting structure.

12. A lamp as in claim 10, wherein said frame members are wires.

13. A lamp as in claim 10, wherein said integral portion comprises an S-shaped bend formed in at least one of said pair of frame members.

14. A lamp as in claim 10, wherein said lamp further comprises a parabolic aluminized reflector having a pair of contact ferrules in which respective frame members are fixed.

15. A lamp as in claim 10, wherein said light source has a ceramic envelope.

16. A lamp as in claim 10, further comprising a tab fixed to one of said frame members above said upper end of said sleeve, thereby holding said lower end against said integral portions.

17. A lamp as in claim 10, wherein said frame members are identical.

18. A lamp member as in claim 10 wherein said frame members are electrically connected to respective leads of said light source, and provide current to said light source.

19. A lamp comprising:

a light source having a pair of opposed leads, a sleeve around the light source, said sleeve having an upper end and a lower end, and a frame supporting said sleeve and said fight source, said frame comprising a first frame member and a second frame member extending through said sleeve, said first frame member being identical to said second frame member, wherein said first frame member and said second frame member each have an identical well that receives said lower end to support said sleeve.

20. A lamp as in claim 19, further comprising a tab fixed to one of said frame members above said upper end of said sleeve to hold said lower end against said bent portions.

21. A lamp comprising:

a light source;

a sleeve around said light source;

a pair of frame members each having an upper portion, a middle portion and a lower portion; said lower portions each including a curved portion having a well, said wells receiving said sleeve; said middle portions each extending through said sleeve; and a spacer located between said pair of frame members at said upper portion so that said middle portions of said pair of frame members bear against an inside surface of said sleeve.

* * * * *